US006241628B1

(12) United States Patent
Jenkins et al.

(10) Patent No.: US 6,241,628 B1
(45) **Date of Patent: *Jun. 5, 2001**

(54) PROJECTILE MACHINE WITH REMOTE CONTROL FOR BASKETBALL PRACTICE AND THE LIKE

(75) Inventors: Craig D. Jenkins, 8789 W. Cornell Ave. #10-6, Lakewood, CO (US) 80227; Scott E. Jenkins, 10170 W. Alamo Pl., Littleton, CO (US) 80127; Robert M. McClure, Evergreen, CO (US)

(73) Assignees: Craig D. Jenkins, Lakewood; Scott E. Jenkins, Littleton, both of CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/965,931

(22) Filed: Nov. 7, 1997

(51) Int. Cl.[7] ..... A63B 69/00

(52) U.S. Cl. ..... 473/436; 473/431; 473/422; 124/6

(58) Field of Search ..... D21/720; 273/357, 273/384; 473/436, 459, 247, 460, 433, 431; 124/51.1, 44.7, 50, 81, 82, 56, 16, 6, 78

(56) References Cited

U.S. PATENT DOCUMENTS

| | | | | |
|---|---|---|---|---|
| 1,198,300 | * | 9/1916 | Watkins | 124/6 |
| 2,182,369 | * | 12/1939 | Barron | 124/81 |
| 2,526,018 | * | 10/1950 | Foster et al. | 124/73 |
| 2,908,266 | * | 10/1959 | Cooper | 124/6 |
| 3,467,073 | * | 9/1969 | Rhodes | 124/50 |
| 3,662,729 | * | 5/1972 | Henderson | 124/73 |
| 3,776,550 | * | 12/1973 | McNabb | 473/436 |
| 4,091,791 | * | 5/1978 | Castelli | 124/44.7 |
| 4,423,717 | * | 1/1984 | Kahelin | 124/78 |
| 4,579,340 | | 4/1986 | Jenkins et al. | 273/1.5 A |
| 4,678,189 | * | 7/1987 | Koss | 473/436 |
| 4,714,248 | * | 12/1987 | Koss | 473/436 |
| 4,940,231 | * | 7/1990 | Ehler | 473/431 |
| 5,487,540 | * | 1/1996 | Bixler | 473/436 |
| 5,494,022 | * | 2/1996 | Sung | 124/16 |
| 5,749,797 | * | 5/1998 | Sunseri et al. | 473/451 |
| 5,776,018 | * | 7/1998 | Simpson | 473/433 |
| 5,813,391 | * | 9/1998 | Johnson | 124/6 |

* cited by examiner

*Primary Examiner*—Jeanette Chapman
*Assistant Examiner*—Mitra Aryanpour
(74) *Attorney, Agent, or Firm*—Jacobson, Price, Holman & Stern, PLLC

(57) ABSTRACT

A projectile machine for use in practicing various activities including the practice of basketball shots from various positions on a basketball court. The projectile machine when practicing basketball shots automatically returns the basketballs to the person practicing shots thereby eliminating the necessity for the practicing player or other players to retrieve the basketballs that have been shot and return them to the player practicing the shots. More specifically, the present invention enables basketballs that have been shot towards the basketball goal or hoop to be automatically collected and mechanically returned to a selected on-court location at varying elevations, trajectories and velocities. The projectile machine can also be used during various activities relating to the practice of various endeavors in which an article is projected in a desired trajectory. The projectile machine may be supported from a support post for the backboard and goal for use as a home unit. The projectile can be projected by moving a projectile between retention members by a power device or the retention members may be moved past a stationary projectile by a power device to project the projectile.

16 Claims, 13 Drawing Sheets

PROJECTILE MACHINE WITH REMOTE CONTROL FOR BASKETBALL PRACTICE AND THE LIKE

BACKGROUND OF THE INVENTION

1. Field of the Invention

The present invention generally relates to a projectile machine for use in practicing various activities including the practice of basketball shots from various positions on a basketball court. The projectile machine when practicing basketball shots automatically returns the basketballs to the person practicing shots thereby eliminating the necessity for the practicing player or other players to retrieve the basketballs that have been shot and return them to the player practicing the shots. More specifically, the present invention enables basketballs that have been shot towards the basketball goal or hoop to be automatically collected and mechanically returned to a selected on-court location at varying elevations, trajectories and velocity. The projectile machine can also be used during various activities relating to the practice of various endeavors in which an article is projected in a desired trajectory.

2. Description of the Prior Art

Basketball players spend considerable time and effort in practicing shots from various positions on the basketball court. When doing so, it is necessary for the individual to retrieve each basketball that is shot or other players retrieve and return the basketballs to the person practicing the basketball shots. In an effort to reduce the necessity of the practicing player or other players retrieving and returning the basketballs to various locations on the basketball court, devices have been developed to collect and return basketballs to various locations on the basketball court.

Prior U.S. Pat. No. 4,579,340, issued Apr. 1, 1986 discloses a machine for collecting and returning basketballs to various locations on the basketball court. The prior art of record in that patent also is relevant to this invention.

The machine disclosed in the above prior patent functions effectively but does not include various capabilities that are desirable when practicing basketball shots. The present invention is constructed so that it returns a basketball to various selected locations on the basketball court by varying the path of trajectory and velocity of the returning basketball. The basketball practice machine of this invention is mobile and can be operated from either a 110 or 12 volt power source, thus enabling operation in both indoor and outdoor environments. Also, the operation of the basketball return machine of this invention may be controlled remotely which enables a player to control the functions of the machine. Additionally, the basketball return machine of this invention includes a net supported by a collapsible frame that collects balls that go through the basketball goal or bounce off the backboard or goal and return them to the machine for projecting the basketballs singly toward different locations on the basketball court.

SUMMARY OF THE INVENTION

The basketball practice device of this invention includes a portable and mobile machine capable of being positioned at a desired location on a basketball court generally underneath the basketball goal and backboard into which shooting practice is to be conducted. The machine includes a base having a ball ejecting or projecting mechanism which can be rotated about a vertical axis for directing balls to a selected on-court location dependent on the angular position about a vertical axis, the angular position about a horizontal axis and the velocity of the basketball as it is ejected or projected. Adjustment of the velocity, the vertical angle of discharge and the horizontal angle of discharge controls the movement characteristics of the returned basketballs.

The basketball return machine includes a collecting net supported from a base with the net having a wide opening at the top. The net is generally of a funnel shape in order to collect the balls from the basketball goal or backboard with the restricted bottom end of the funnel shaped net having an opening to feed the balls by gravity into the ball ejecting or projecting mechanism.

An object of the present invention is to provide a basketball practice device which includes a portable and mobile machine including a funnel shaped net associated with the basketball goal and backboard to collect balls which go through the goal, bounce off the goal or backboard and return them by gravity to a basketball ejecting or projecting mechanism that returns the balls to a desired on court location dependent upon the positioning and adjusted characteristics of the ball ejecting or projecting mechanism.

Another object of the invention is to provide a basketball practice device in which the ball ejecting or projecting mechanism is adjustable about a vertical axis to angularly select the desired direction of the ball to different spaced locations on the basketball court.

A further object of the invention is to provide a basketball practice device in accordance with the preceding objects in which the angular relation of the trajectory path about a horizontal axis can be adjusted for returning the basketball to a practice player at various distances and elevations from the ejecting or projecting mechanism.

An additional object of the invention is to provide a basketball practice device in which the basketball ejecting mechanism is capable of adjusting the velocity of the basketball when discharged for causing the ball to be projected a greater distance or at a higher elevation.

Still another object of the invention is to provide a basketball practice device in accordance with the preceding object in which the basketball ejecting mechanism includes a pair of spaced rollers and a plunger which forces the basketball between the rollers with the spaced relationship of the rollers determining the velocity of the basketball as it leaves the ejecting mechanism.

A still further object of the invention is to provide a basketball practice device in which the device includes a collapsible collection net that is removably attached to a mobile supporting base having the ejecting mechanism mounted thereon.

Another object of the invention is to provide a basketball practice machine with an ejecting mechanism that is adjustable about a vertical axis and a horizontal axis with the rotation or adjustment of the ejecting mechanism being programmed to discharge basketballs in accordance with a predetermined pattern or a random pattern or discharge of basketballs which may be controlled remotely by a unit operated by a coach, player or players.

Yet another object of the invention is to provide a basketball practice device in accordance with the preceding objects which effectively collects and returns basketballs which have been shot at a basketball goal in order for the player practicing basketball shots to continuously shoot practice shots without having to retrieve basketballs or have others retrieve basketballs with the basketball practice device returning the balls to on court locations at varying velocities and trajectories to enable a basketball player to not only practice basketball shots but also become more proficient in catching and handling basketballs returned by the device.

Another feature of this invention is to provide a basketball practice device in accordance with the preceding objects which is adapted for home use by mounting the projecting mechanism on a supporting post for the backboard and goal.

Still another feature of this invention is a projecting mechanism which includes powered projectile retention members which move past the projectile to eject the projectile in a desired trajectory.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
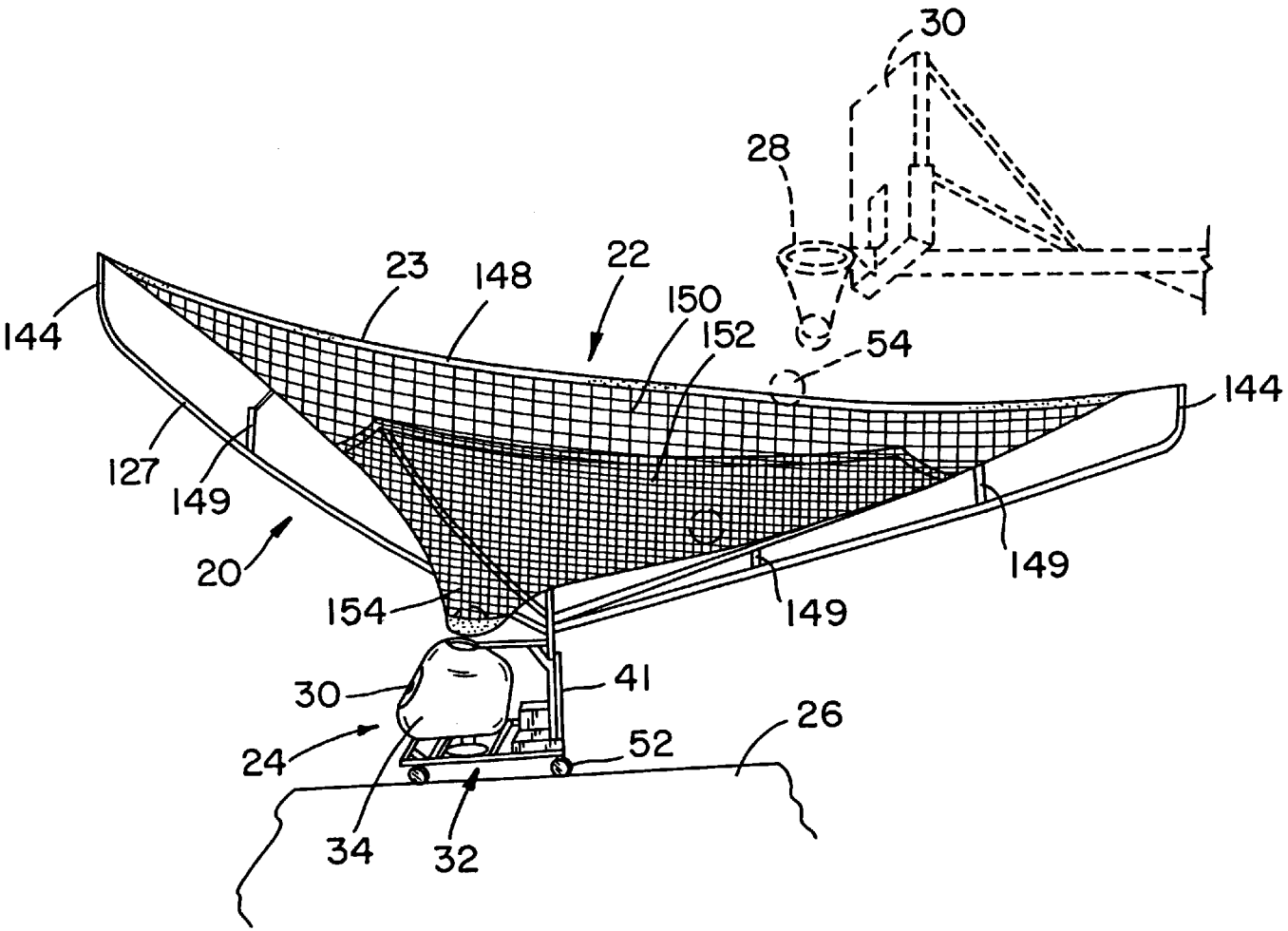
FIG. 1 is a perspective view illustrating a preferred basketball practice device in accordance with the present invention positioned on a basketball court in relation to a basketball goal and backboard for collecting basketballs which go through the goal, bounce off the goal or backboard and return them to a basketball ejection mechanism.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

As illustrated in FIG. 1, the basketball practice device of the present invention is generally designated by reference numeral 20 and includes a collection net generally designated by reference numeral 22 and a portable, mobile basketball ejecting or projecting mechanism generally designated by reference numeral 24 which is supported on the basketball court 26 or other similar horizontal supporting surface. As illustrated, the collection net 22 is generally funnel shaped with an open top 23 and is located in alignment with and below a basketball goal or basket 28 and backboard 30 of conventional construction so that basketballs 54 which go through the goal 28, bounce off the goal 28, bounce off the backboard 30 or miss the goal 28 will be caught by the open topped funnel shaped collection net 22 and returned by gravity to the ball ejecting mechanism 24.

Figure 2:
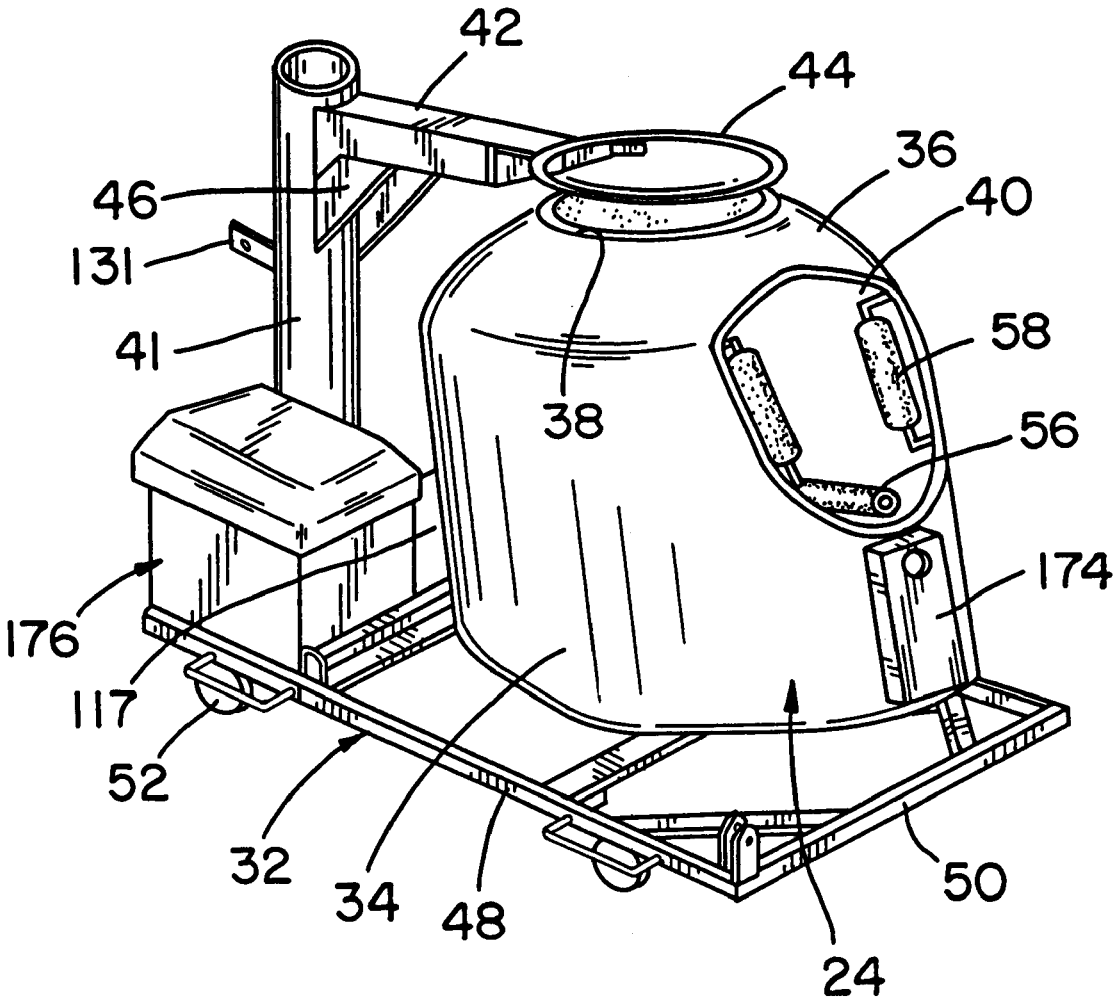
FIG. 2 is a perspective view of a preferred basketball ejection mechanism of the present invention.
Figure 9:
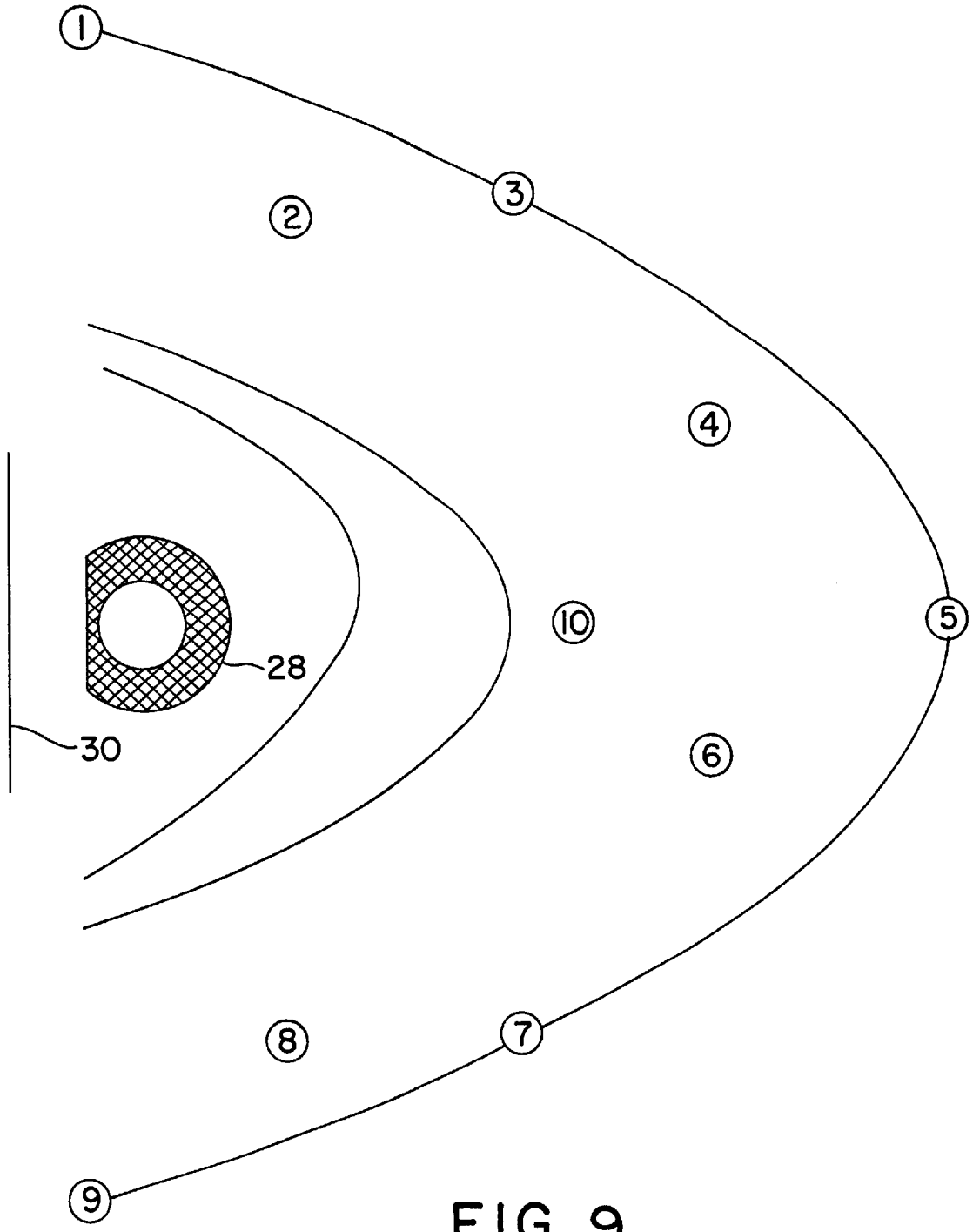
FIG. 9 is a schematic illustration of a basketball court with typical on court locations being designated to enable a player to move from one location to another dependent upon the manner in which the ball ejecting mechanism of the present invention is programmed to eject balls to the various locations.

The ball ejecting mechanism 24 illustrated in FIG. 2 includes a base preferably in the form of a horizontal framework generally designated by reference numeral 32 and a generally vertically extending hollow housing 34 supported thereon. The hollow housing 34 includes a generally convexly rounded upper end 36 having an inlet opening 38 therein to enable basketballs 54 to move downwardly into the housing 34 by gravity. The forward upper portion of the housing 34 includes an enlarged opening 40 through which basketballs 54 can be ejected to various locations on the basketball court 26 such as the numbered locations 1–10 as illustrated in FIG. 9.

The rearward portion of the horizontal frame 32 includes a vertical support tube 41 rigid with the base 32 and oriented centrally at the rear edge thereof as illustrated in FIG. 2. The upper end of the support tube 41 is provided with a forwardly extending bracket 42 which supports a horizontally disposed circular ring 44 in close overlying proximity to the inlet opening 38. The support tube 41 is preferably provided with gusset type braces 46 connected to the bracket 42 for rigidifying this structure. As illustrated, the horizontal base 32 is in the form of an open frame including side rails 48 and transverse rails or frame members 50. The base 32 is supported by wheels 52 preferably located adjacent each corner of the rectangular base with the wheels 52 either being caster wheels or at least one pair of the wheels at one end of the base being caster wheels to enable the ejection mechanism 24 to be easily rolled along a basketball court surface 26 or along any other supporting surface. The ring 44 is connected to the lower end of the collecting net 22 in a manner described hereinafter and serves to discharge basketballs 54 through the inlet opening 38 into the interior of the housing 34.

FIGS. 3–6 illustrate the structure interiorly of the housing 34 which supports and ejects basketballs 54. This structure includes a pair of generally horizontally disposed supports 56 which are spaced apart a predetermined distance and a pair of generally vertically disposed adjustable rollers 58. The supports 56 which may be cylindrical or other configurations and are spaced apart a distance to support a basketball 54 along lower portions thereof on each side of the center of the basketball, and the vertical rollers 58 are adjustably positioned so that they will squeeze the basketball as it is pushed between the rollers 58 for ejecting the basketball 54 at an adjustable velocity.

Figure 3:
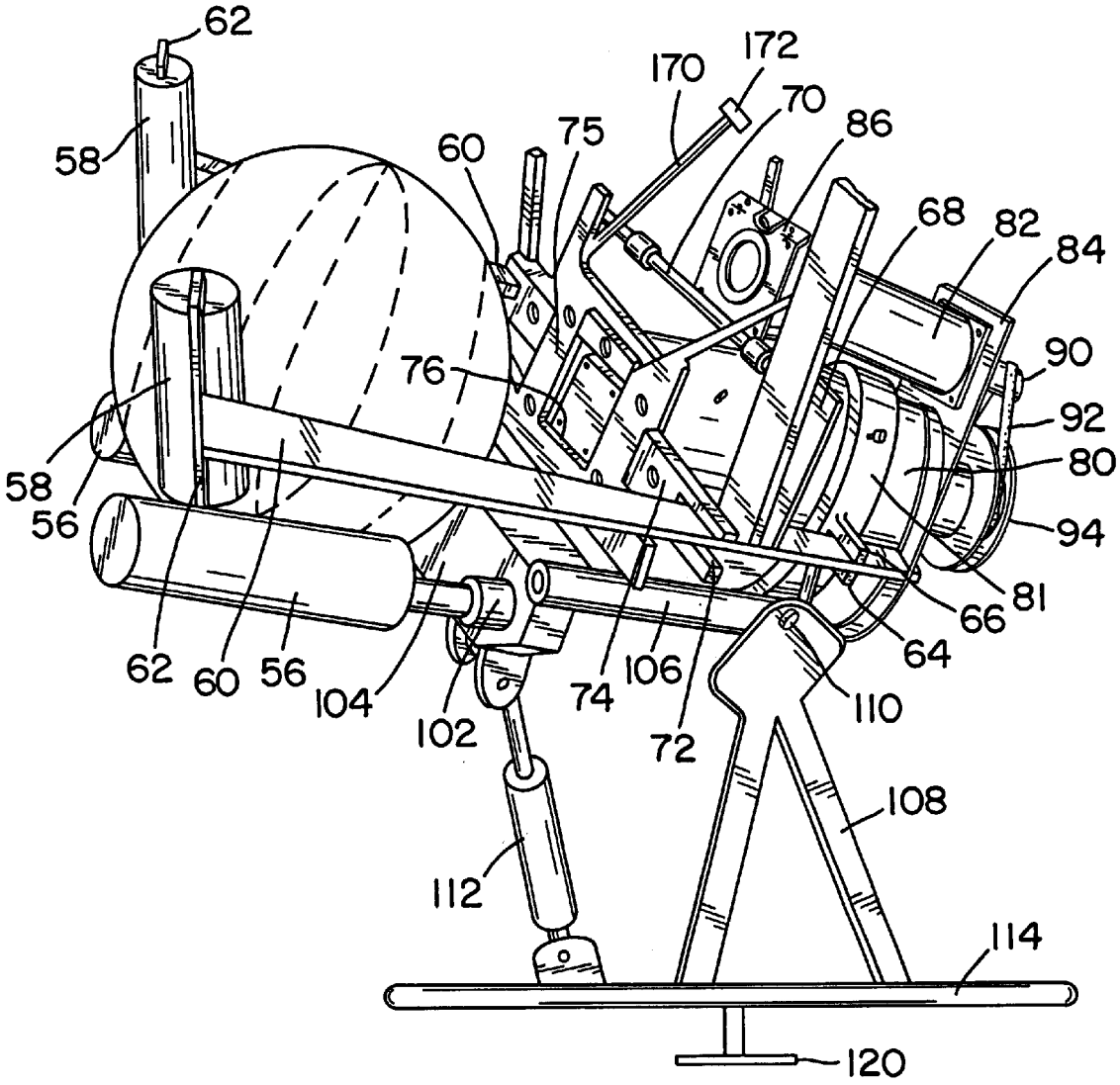
FIG. 3 is a perspective view of the mechanism for supporting a returned basketball and ejecting the basketball from the ejecting mechanism of FIG. 2.
Figure 4:
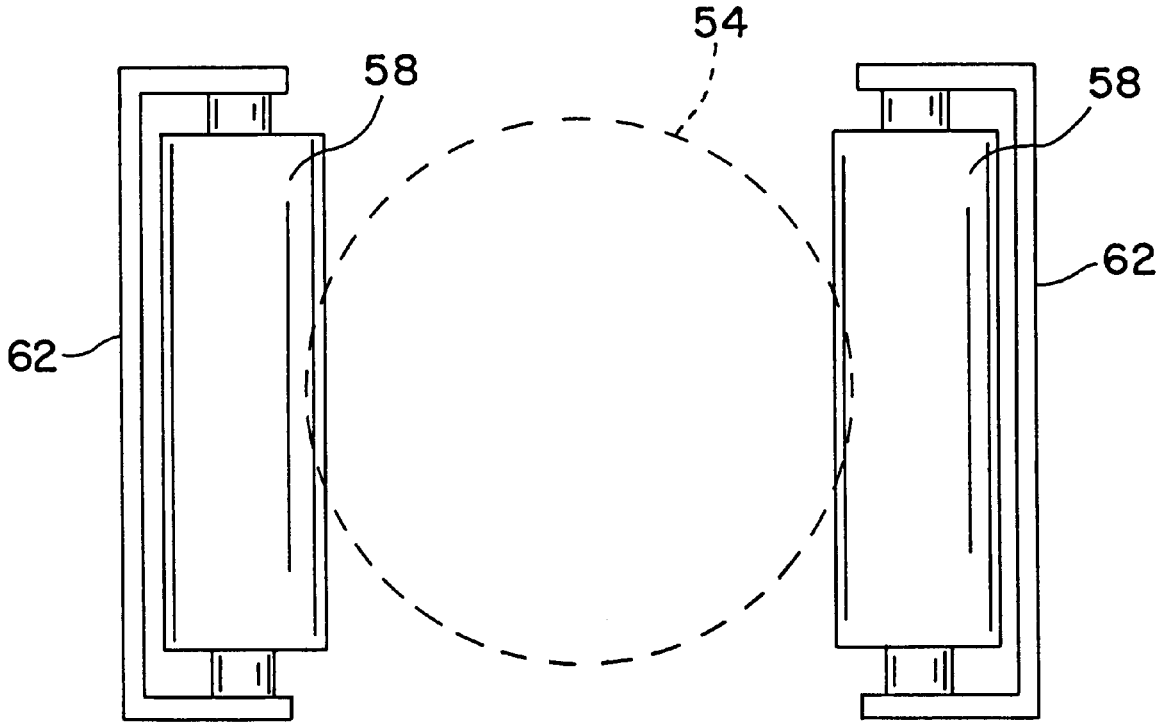
FIG. 4 is a detailed elevational view of the adjustable rollers which control the velocity of discharge of the basketballs from the ejecting mechanism of FIG. 2.
Figure 5:
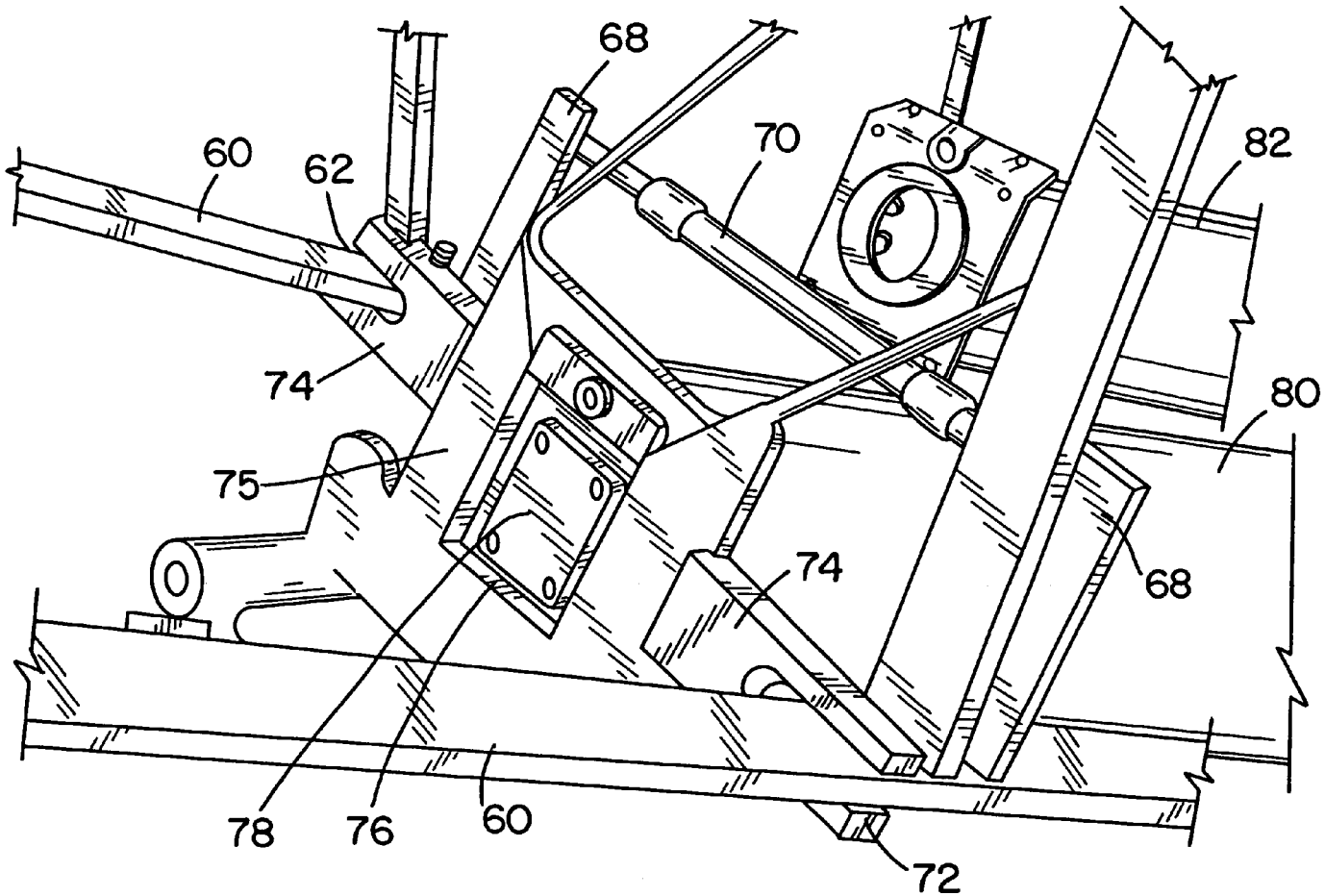
FIG. 5 is a detailed perspective view illustrating additional structure details of the preferred ejecting mechanism of the present invention.
Figure 6:
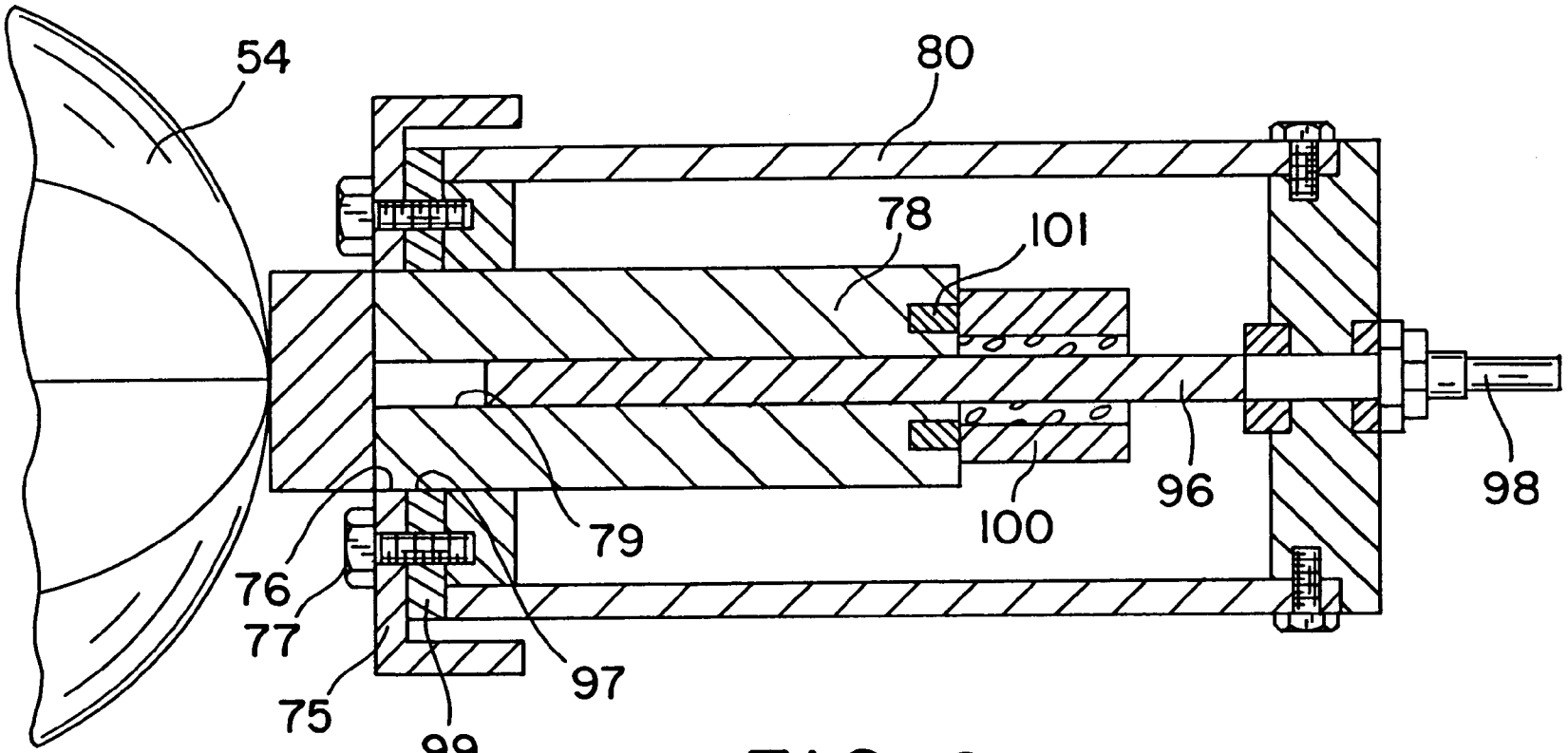
FIG. 6 is a longitudinal sectional view of the plunger structure for ejecting the basketball in accordance with the preferred ejection mechanism of the present invention.

The rollers 58 are each supported by an elongated support arm 60 having a generally U-shaped mounting bracket 62 affixed to the outer end thereof with the mounting bracket 62 engaging and rotatably supporting opposite ends of the rollers 58. As illustrated in FIGS. 3 and 4, rollers 58 are not directly connected to any driving mechanism. The rearward ends of each of the arms 60 are pivotally supported by a bracket 64 in order for the rearward ends of the arms 60 to pivot about a generally vertical pivot axis defined by pivot bolt 66. Each of the arms 60 includes an upstanding centrally located bracket 68 that are interconnected by an adjustment mechanism 70 capable of swinging the outer ends of arms 60 and the rollers 58 towards each other and away from each other. The arms 60 are guided during their swinging movement by laterally extending open ended slots 72 in outer ends of transversely extending support members 74. The support members 74 are rigidly affixed to a central plate 75 which includes an enlarged central opening 76 through which a plunger 78 preferably in the form of a square tube can pass. The plunger 78 engages the basketball 54 and moves the basketball outwardly. As it moves outwardly, the ball 54 will engage and rotate the rollers 58 as the ball is squeezed at its opposite sides by the rollers 58 until the center of the ball passes the center of the rollers 58 at which time the basketball will be ejected or projected at a predetermined velocity depending upon the position of rollers 58 and in a trajectory determined by the position of the supporting structure for the ejecting mechanism as described hereinafter.

As illustrated in FIGS. 3–6, the rectangular plunger 78 is telescopically disposed in a cylinder 80 which is supported from the support plate 75 at one end by bolts 77. The opposite end of the cylinder 80 is rigidly supported by a collar 81. A reversible electric motor 82 that is parallel to the cylinder 80 and the plunger 78 received in the cylinder has an outer end supported by a support plate 84 rigidly connected to cylinder 80. The other end of motor 82 is provided with an end plate 86 so that motor 82 is rigidly connected to the cylinder 80. The motor 82 includes a drive pulley 90 driving a belt 92 which drives a pulley 94 on a shaft 96 journaled in the inner end of cylinder 80 and which is in the form of a ball shaft with the pulley 94 being mounted on an input end 98 of shaft 96. The shaft 96 interiorly of the cylinder 80 is rotatably and telescopically received in a bore 79 in plunger 78. The plunger 78 is square and extends through a square opening 97 in an end plate 99 on the cylinder 80 and the square hole 76 in plate 75 to engage basketball 54. The bolts 77 secure end plate 99 and thus the cylinder 80 to plate 75. The ball shaft 96 extends through a ball nut 100 which is anchored to the inner end of the plunger 78 at 101. Thus, when the shaft 96 is rotated, the nut 100 which is stationary since it is rigid with the square plunger 78 which extends through the square hole 97 in the end plate 99 will cause the plunger 78 to move either inwardly or outwardly depending upon the rotational direction of the ball shaft 96. Thus, with the reversible variable speed motor 82 driving the ball shaft 96 in a selected direction, the plunger 78 can be extended or retracted at a predetermined speed. When the plunger 78 is extended, the basketball 54 will be pushed through the squeeze rollers 58 to a degree that the center of the ball will pass the center of the rollers 58 and be projected due to the forces exerted on the periphery of the ball as the center of the basketball 54 passes the center of the rollers 58. After each ejection, the plunger 78 is retracted by reversing the rotational output of the motor 82 to enable a subsequent basketball 54 to fall by gravity onto the supports 56.

The supports 56 are rigidly welded to short sleeves 102 welded to a transverse support plate 104 which forms a subassembly along with a subframe 106 which extends rearwardly and is pivotally supported by a depending frame structure 108 at each side of subframe 106 for pivotal movement about a horizontal pivot axis defined by pivot bolts 110. An extendable and retractable adjustment structure 112 extends between a base plate 114 and the support plate 104 for pivoting the subframe 106, the support plate 104, cylinder 80, motor 82, plunger 78, supports 56, rollers 58 and arms 60 about the transverse horizontal axis defined by pivot bolts 110 thus varying the vertical angle of the trajectory of the basketball when it is discharged. This is accomplished by adjusting the adjustment mechanism 112 which is in the form of a power device which can be extended and retracted. The velocity of discharge of the basketball 54 is determined by the position of the rollers 58 which can be adjusted by the adjustment mechanism 70 which pivots the arms 60 and thus the rollers 58 toward and away from each other about the pivot axis defined by the pivot bolts 66 connecting the arms 60 to brackets 64.

Figure 7:
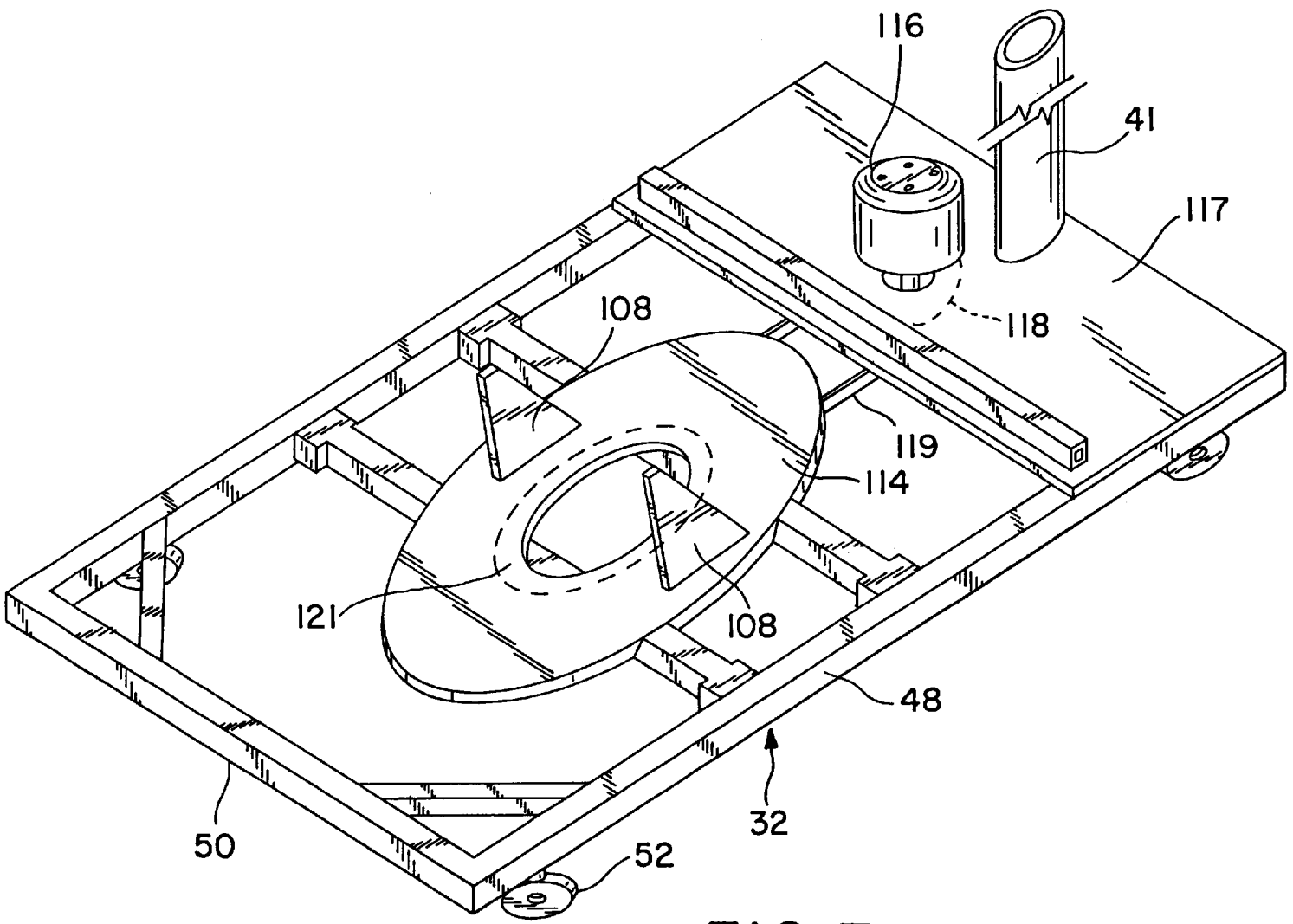
FIG. 7 is a perspective view of the base of the preferred ejecting mechanism of the present invention, illustrating the manner in which the ejecting mechanism is rotated about a vertical axis.

The base plate 114 is circular in configuration as illustrated in FIGS. 3 and 7 with the inverted V-shaped frames 108 which support subframe 106 being connected to and mounted on opposite side portions of the plate 114 for rotation with the plate 114. In order to rotate the plate 114 about a vertical axis to vary the angle of discharge of the basketball in a horizontal plane about a vertical axis, the plate 114 is driven by a motor 116 supported on base 32 by a plate 117 adjacent vertical tube 41. The motor 116 has an output pulley 118 under plate 117 with a belt 119 driving pulley 120 connected with the outer race of a lazy susan bearing assembly 121 which has the inner race connected to plate 114 to pivot the plate 114 about a vertical axis. The motor 116 is a reversible electric motor and can thus rotate the base plate 114 in either direction about a vertical axis for causing the ball to be discharged in various directions. The motor 116 also has a position encoder built into it to stop the ejecting mechanism at programmed positions.

Figure 8:
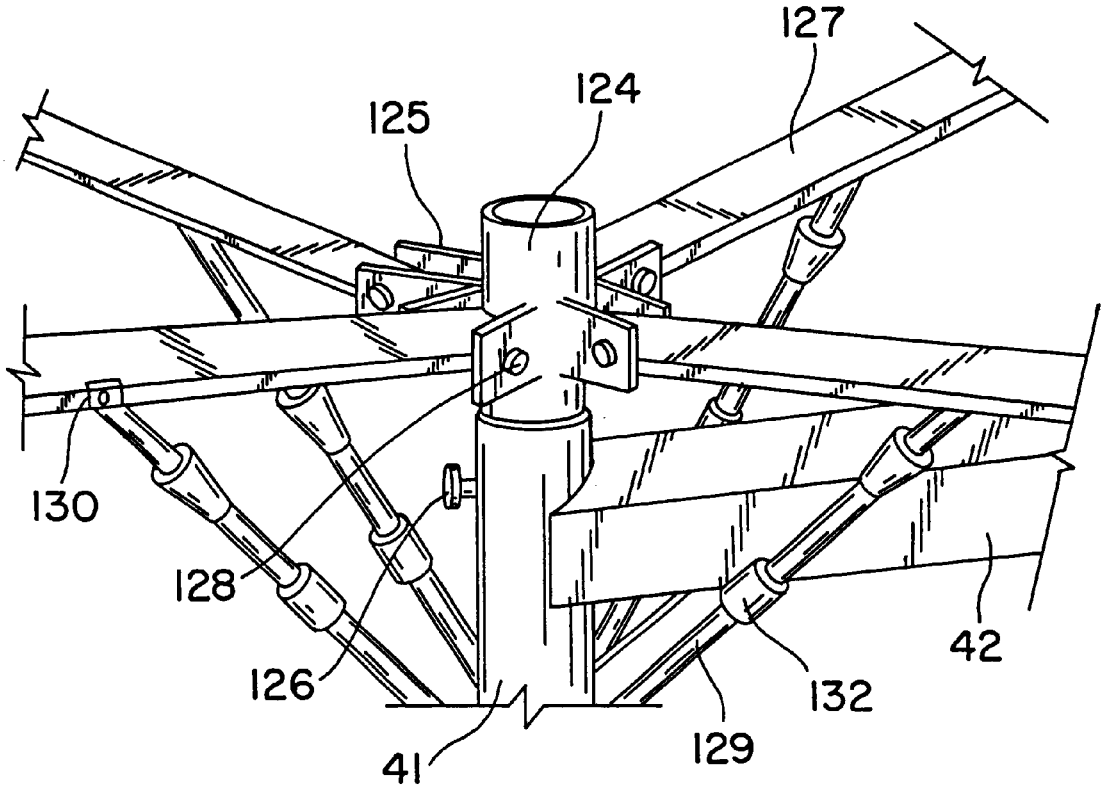
FIG. 8 is a perspective view of a portion of the preferred collecting net support structure of the present invention.

Additional details of the funnel shaped net 22 are illustrated in FIG. 8 and includes a vertical tubular member 124 telescoped into the tube 41 and secured in position by a set screw or fastener bolt 126. The tubular member 124 has a plurality of pairs of lugs 125 which support stanchions or arms 127 for pivotal movement about hinge pins or bolts 128. The stanchions 127 extend radially and have upturned ends 144 and connect to the upper end 23 of net 22 as shown in FIG. 1. The top cord 148 pulls the ends of the stanchions 127 up and brace bars 129 pull the stanchions 127 down. The upper ends of the brace bars 129 are pivoted to the under side of stanchions 127 at 130 and the lower ends are pivoted to lugs 131 on tube 41. The brace bars 129 are telescopically adjustable and include a twist lock device 132 as shown in FIG. 8. This type of adjustment can also be used to adjust the length of the stanchions 127.

The upper end 23 of net 22 is defined by and supported by a peripheral member 148 of flexible construction which is connected to the upper ends of the upturned ends 144 of the arms 127. The mesh net 150 is supported from the peripheral member 148 and includes a reinforcement area 152 incorporated therein having a funnel shaped lower end 154 which is attached to the ring 44 so that all basketballs will pass through the lower end 154 and through the ring 44 which is aligned with the inlet opening 38 thereby depositing the basketballs into the projecting mechanism 24. The net 150 is also connected to each of the stanchions 127 by short vertical members 149 which tension the net by pulling the net downwardly against the peripheral member 148.

Figure 10:
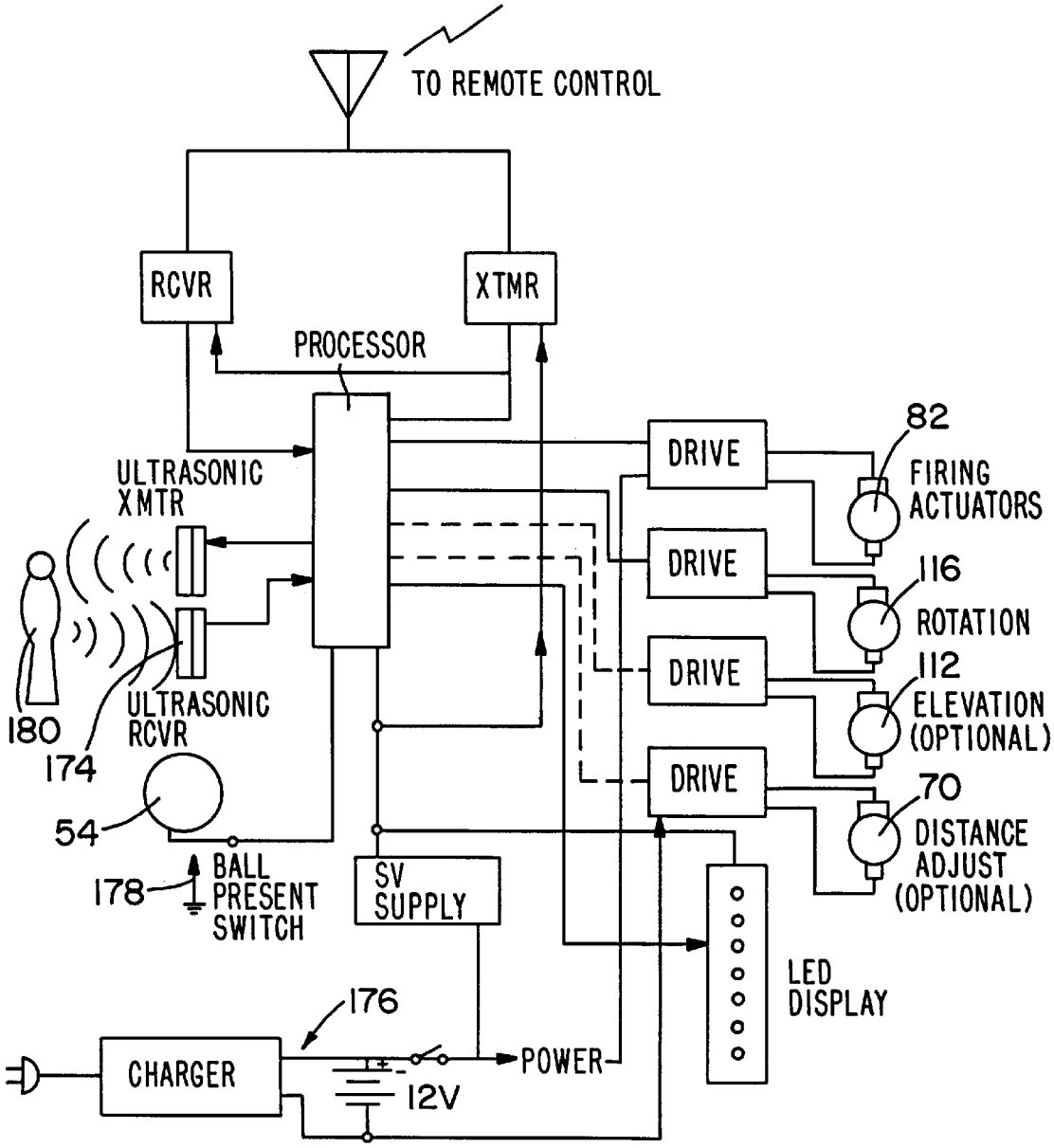
FIG. 10 is a schematic illustration of the main control unit in the ball ejecting mechanism in accordance with the present invention.
Figure 11:
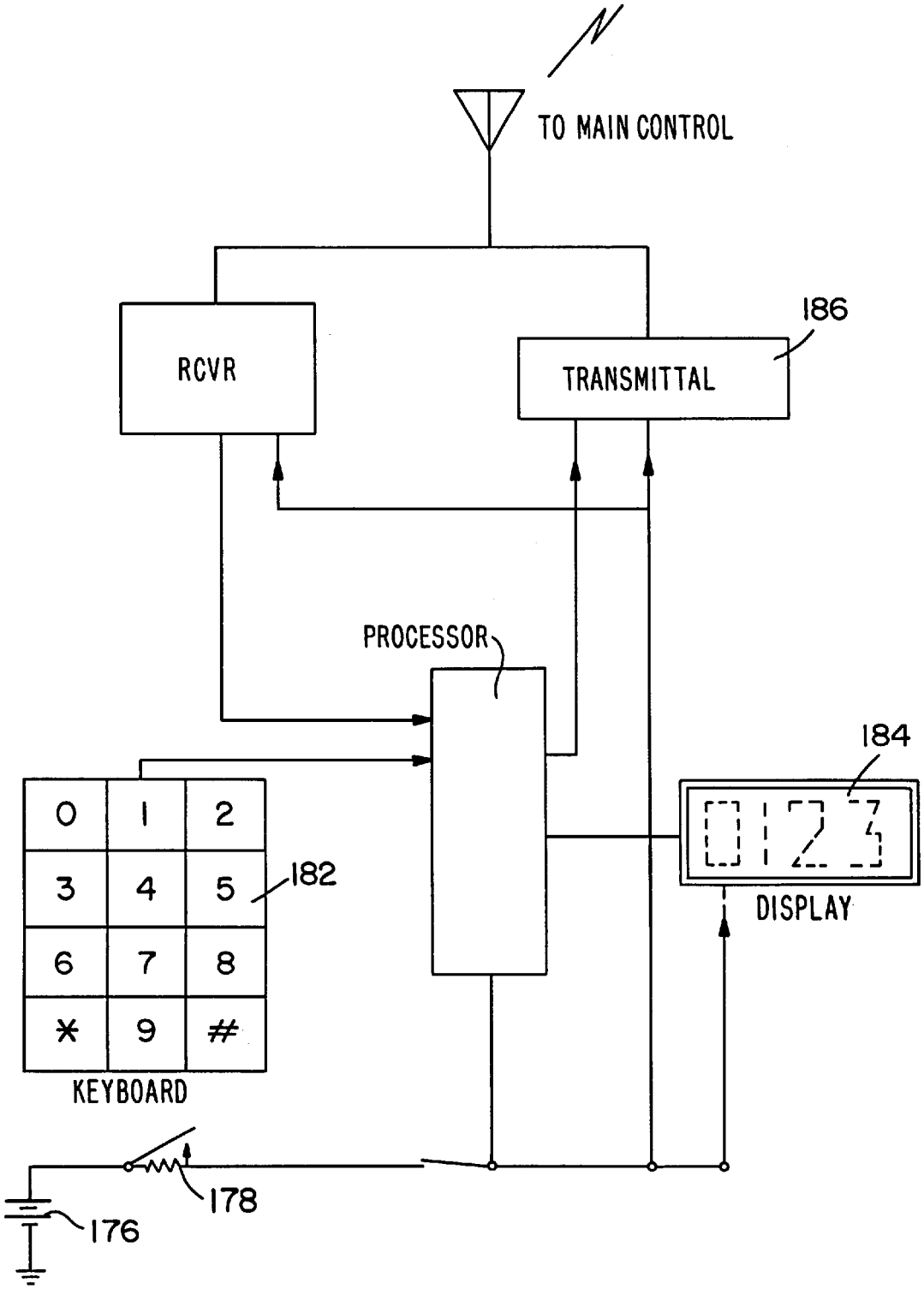
FIG. 11 is a schematic illustration of the remote control unit of the present invention.

The housing 34 is supported from the framework by a plurality of upwardly extending support rods 170 having angled plates on the upper end as designated by reference numeral 172 which engage and are secured to the inner surface of the housing in a manner which enables the housing to be removed for adjustment, repair and the like if necessary. Also, in the end of the housing under the ejection opening 40, a sensor panel 174 is mounted to sense the presence of a player so that the ejection mechanism will be rendered inoperative as a safety measure in the event a player is standing closely adjacent and in alignment with the discharge opening 40. Also, mounted on the plate 117 is a battery assembly 176 which includes a low voltage storage battery such as a 12 volt battery or the like together with a battery charger to recharge the battery when necessary thus enabling the device to be operated independently of an electrical outlet. However, if desired, a electrical supply system may be provided by a plug into an electrical outlet with a suitable power reduction being employed for the mechanisms which drive the components of the ball ejection mechanism. A switch 178 is provided to sense the presence of a basketball 54 as illustrated in FIG. 10 which also illustrates the relationship of the sensor panel 174 to a player 180. FIG. 10 also illustrates the control mechanism and power supplier including the battery and charger together with the drive motor 116 for rotating the base plate 114, pivoting the subframe and adjusting the rollers for determining the velocity of discharge of the basketball together with a firing actuator for the plunger motor. The control assembly illustrated in FIG. 10 is connected to a remote control illustrated in FIG. 11 which includes a portable key pad 182 having numeric designations with a display 184 associated therewith to enable a player to use a transmitter assembly 186 to control operation of the ball ejecting mechanism in a manner well known in the art thereby enabling the operator, either a player, coach or other person to control operation of the ball ejection mechanism and to control projection of the ball to the various court locations identified numerically in FIG. 9. This can be individually controlled in a sequential manner or the sequence of projection of the basketball can be preprogrammed to project the ball sequentially to locations 1–10. Alternatively, the ball ejection mechanism may randomly direct the ball to an on-court location as selected by a remote control operator.

Figure 12:
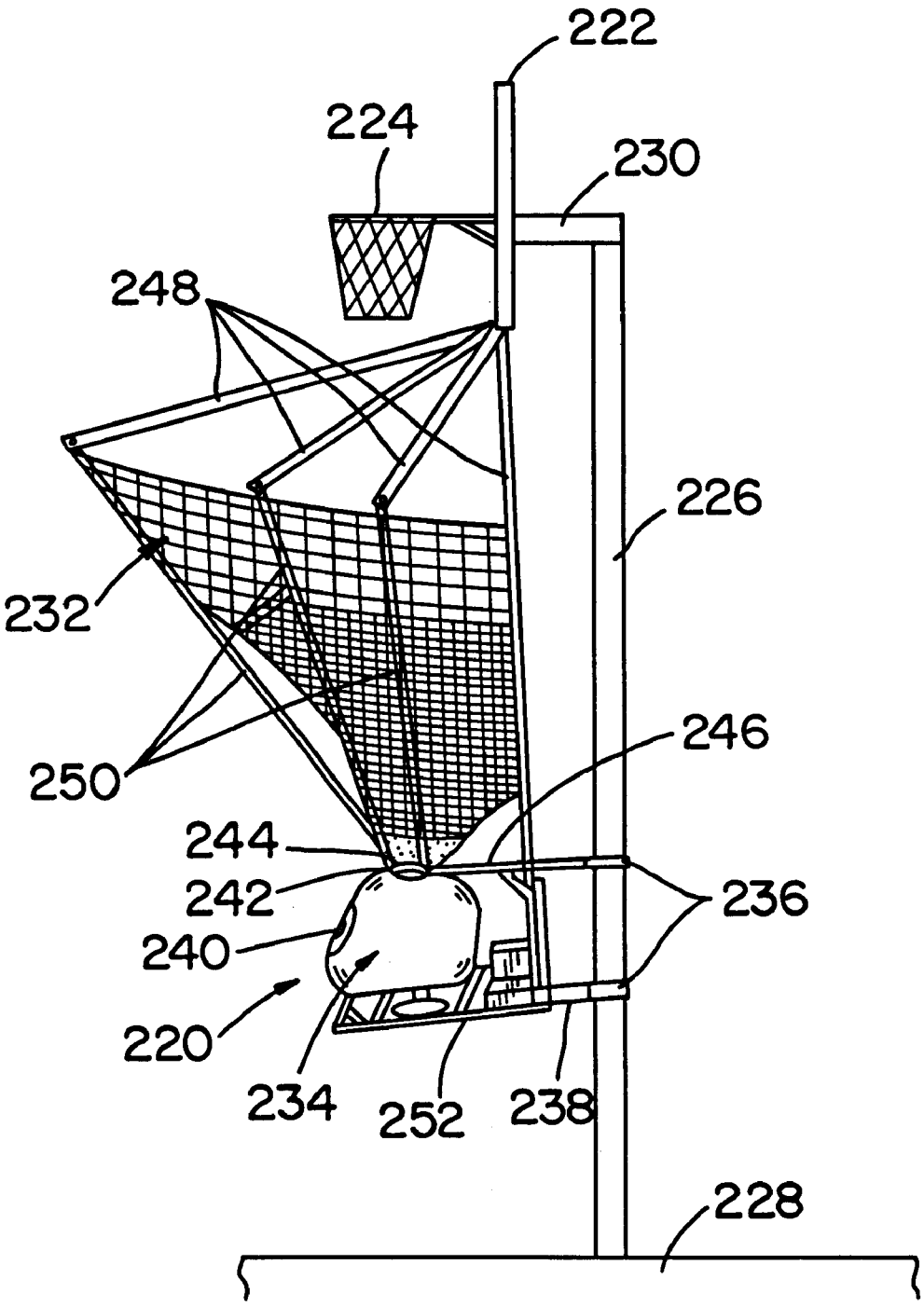
FIG. 12 is a side elevational view of an embodiment of the practice device mounted on a supporting post for the backboard and basketball goal.

FIG. 12 illustrates another embodiment of the basketball practice device generally designated by reference numeral 220 which is adapted for use as a home unit where a backboard 222 and a basketball goal and net 224 mounted on the backboard 222 is supported by a vertically disposed support post 226 inserted into a pavement or ground surface 228 or attached to a weighted base such as a sand filled base well known in this art. The upper end of the post 226 includes a support member 230 which connects to the backboard and any suitable reinforcements may be provided to stabilize the backboard. The supporting posts, the backboard and basketball goal and net are all conventional and are supported in a conventional manner.

The practice device 220 includes a collection net 232 and a projecting mechanism 234 which is the same as the projection mechanism illustrated in FIGS. 1–11 except that the supporting casters or wheels have been omitted. The projecting mechanism 234 is supported from the post 226 by a pair of vertically spaced support brackets 236 and support arms 238. Any suitable support brackets and supporting structure for the projecting mechanism may be used to support the projecting mechanism 234 in a suitable elevated relation to the support surface. The projecting mechanism 234 operates and functions in the same manner as that illustrated in FIGS. 1–11 and includes an ejection opening 240 and an inlet opening 242 in alignment with a ring 244 attached to the lower end of the net 232 and supported by a bracket structure 246.

The net is associated with the backboard and goal in generally the same manner as in FIG. 1 except that the inner end of the net is generally in alignment with the backboard to prevent basketballs from passing under the bottom edge of the backboard 222 and deflecting them downwardly into the net and may extend laterally beyond the backboard. The net 232 is, in effect approximately one half the size of that illustrated in FIG. 1 and is supported from the bottom edge of the backboard 222 by a plurality of flexible cables, chains, fabric cords or the like as designated by reference numeral 248 so that the net can be adjusted to some extent with respect to the basketball goal 224. The supporting members 248 are flexible and have a small diameter and are spaced apart sufficiently that basketballs passing through the basketball goal, bouncing off the backboard or nearly missing the goal will fall between the supporting cables or lines and enter the open end of the mesh net 232. The net itself will be supported by a plurality of support arms 250 which are pivotally supported at their lower ends by the rigid ring 244 and which are connected at their upper ends to the cables or support lines 248 to enable the contour and position of the open upper end of the net to be varied in relation to the basketball goal and backboard. The lower funnel end of the net 232 is also connected to the ring 244 which maintains the lower end of the net in alignment with the inlet opening 242 so that basketballs can move by gravity from the mesh net 232 into the projecting mechanism 234. This embodiment of the invention operates in the same manner and is controlled in the same manner as that illustrated in FIGS. 1–11 except that the projecting mechanism 234 and the net 232 are supported from the supporting post and backboard thereby providing a less expensive unit for home or outdoor playground use.

While a detailed disclosure of the above invention for use in practicing basketball shots has been specifically disclosed, the above invention can also be used with various other inflated or resilient balls or other shaped projectiles. For example, soccer balls, volleyballs, footballs, tennis balls or the like can be effectively projected by dimensional changes of portions of the projecting device. Also, by constructing the retention rollers with resilient characteristics, projectiles, including balls, of rigid construction can be projected. For example, baseballs and other target type devices, including but not limited to "clay pigeons" used in practicing skeet shooting and other projectiles can be projected which enables the machine user to practice various activities related to the projectiles.

Figure 13:
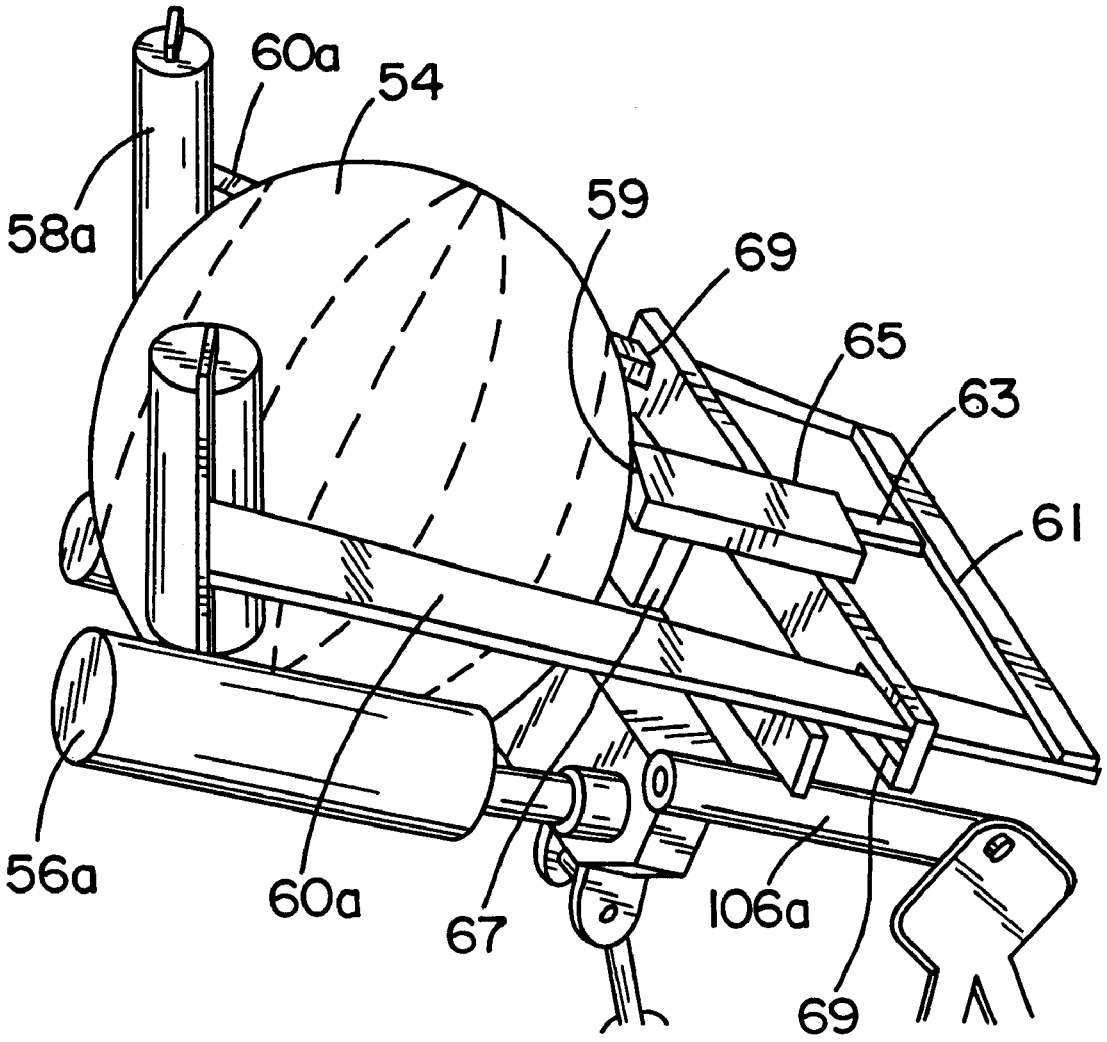
FIG. 13 is a schematic view of an embodiment of the projecting mechanism in which the projectile retention members are moved in relation to a projectile.

Further, while the basketball projection device preferably includes adjustment of the velocity, adjustment in a vertical plane and adjustment in a horizontal plane, the projecting device may be adjusted with respect to one, two or three of the above mentioned adjustments. In addition, the projectile machine disclosed in detail includes a mechanical plunger arrangement, the plunger can be actuated hydraulically or pneumatically. FIG. 13 illustrates another embodiment of the projection mechanism in which the retention rollers 58*a* are the movable components that are associated with a stationary component 59 which retains the ball or projectile in place along with supports 56*a* so that instead of pushing the ball or projectile through the retention rollers 58*a*, the retention rollers are moved toward the stationary component 59 for the projectile. A propulsive thrust or projection thrust is imparted to the ball or projectile by compressing the projectile between the retention rollers or a rigid projectile compressing or partly compressing one or both of the retention rollers as they pass opposed surfaces of the ball or projectile. The retention members may be adjustable or stationary members, or rotatable roller of rigid, flexible or resilient construction.

As schematically illustrated in FIG. 13, the retention rollers 58*a* are supported from a pair of generally parallel arms 60*a* which are connected at their ends remote from the rollers 58*a* by a cross piece 61 that is connected to the core or armature 63 of an electric solenoid 65 supported fixedly by a bracket 67 connected to a support frame 106*a* similar to the frame 106 in FIGS. 1–11. The arms 60*a* are guided by guides 69 during their reciprocating movement in relation to the stationary component or abutment 59 which can be formed by an end of the solenoid 65 or as a separate component. The balls 54 are deposited on the supports 56*a* inwardly of the rollers 58*a* and against stationary member 59 in the same manner as in FIGS. 1–12. The projection mechanism in FIG. 13 functions and is controlled in the same manner as in FIGS. 1–11.

The basketball projecting machine specifically disclosed is supported for movement to different positions on a basketball court. However, as illustrated in FIG. 12 a mounting bracket structure may be provided in lieu of the supporting base to support the projecting device from the vertical post normally provided for supporting a basketball backboard and goal. The features of the projecting device including the mechanism for projecting the projectile and varying the characteristics of the projectile as it is projected are retained in order for the projection device to operate in the same manner as when it is supported by a base and supporting wheels or casters. In this form of the invention, the ball retrieving net would only extend outwardly into the basketball court below the backboard and goal with the collection net having a generally vertically extending portion adjacent the supporting post and would extend to an upper edge adjacent the lower edge of the backboard in order to enable this embodiment of the invention to be easily supported from the supporting posts by bracket structure connected to a support frame 252.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A return machine for inflated basketballs having resilient characteristics comprising a basketball collector having an upper end positioned under a basketball goal to receive basketballs shot toward the goal, and a basketball projecting device positioned to receive basketballs from the basketball collector and projecting the basketballs toward at least one location on a basketball court to enable practice shots from such location without the necessity of retrieving basketballs shot toward the goal, said basketball projecting device including at least one of means to project basketballs, means to vary the trajectory of basketballs in a vertical plane and means to vary the direction of trajectory of basketballs in a horizontal plane, said means to project basketballs including a pair of undriven rollers rotatably supported on said projecting device, said roller being laterally adjustable and spaced apart a distance less than the diameter of an inflated basketball and means pushing the basketballs through the space between the rollers to squeeze and resiliently deform opposite portions of the inflated basketball inwardly until the center of the basketball passes the rotational center of the rollers thereby enabling the deformed portions of the inflated basketball to resiliently return to original shape thereby exerting a reactive force against the rollers and ejecting the basketball toward said location on the basketball court.

2. The basketball return machine as defined in claim 1 wherein said collector includes a net having a large upwardly opening upper end underlying and being independent of the basketball goal and backboard, said net tapering downwardly and inwardly from said upper end to a basketball outlet opening formed by a rigid ring, said basketball projecting device including a housing having an upwardly opening inlet in alignment with said ring forming the net outlet opening for receiving basketballs from the net.

3. The basketball return machine as defined in claim 2 wherein said net is supported by a frame extending upwardly from said basketball projecting device.

4. The basketball return machine as defined in claim 1 wherein said basketball projecting device includes a wheeled mobile frame to enable the projecting device to be movably supported on a basketball court.

5. The basketball return machine as defined in claim 1 wherein said projecting device includes a housing, said housing including a basketball outlet opening and a basketball inlet, said means to vary the trajectory in a horizontal plane including a support structure for said housing for pivoting said housing in a horizontal plane about a vertical axis.

6. The basketball return machine as defined in claim 5 wherein said means to vary trajectory in a vertical plane includes a support structure for said housing to pivot the housing in a vertical plane about a horizontal axis to vary the trajectory of basketballs projected from the projecting device in a vertical plane.

7. The basketball return machine as defined in claim 5 wherein said support structure for said housing includes a supporting base, a base plate, means rotatably mounting said base plate on said supporting base, means on said supporting base drivingly connected to said base plate to rotate said base plate in either direction about a vertical axis to vary the position of said basketball outlet in the housing about a vertical axis.

8. The basketball return machine as defined in claim 6 wherein said support structure includes a subframe supporting said housing, means supporting said subframe from a supporting base for pivotal movement about a transverse horizontal axis, and a power device to pivot said subframe about a transverse horizontal axis to move the housing about a transverse axis to vary the trajectory of a basketball in a vertical plane.

9. The basketball return machine as defined in claim 1 wherein basketballs are projected from the projecting device in predetermined or random pattern.

10. The basketball return machine as defined in claim 9 wherein said pattern of discharge of basketballs is remotely controlled.

11. The basketball return machine as defined in claim 1 wherein said projecting device is battery or AC powered.

12. The basketball return machine as defined in claim 1 wherein said housing includes a player proximity sensor to prevent discharge of basketballs when a player is located too close to a basketball outlet in said housing.

13. The basketball return machine as defined in claim 1 wherein said basketball projecting device is supported from a support post for said basketball goal.

14. A basketball return machine comprising a basketball collector having an upper end positioned under a basketball goal to receive basketballs shot toward the goal, and a basketball projecting device positioned to receive basketballs from the basketball collector and projecting the basketballs toward a plurality of locations on a basketball court to enable a player to practice shots from such locations without the necessity of retrieving the basketballs shot toward the goal, said basketball projecting device including means to vary the velocity of the projected basketballs, means to vary the trajectory in a vertical plane and means to vary the direction of trajectory in a horizontal plane, said collector including a net tapering downwardly and inwardly to a basketball outlet opening, said basketball projecting device including a housing having an upwardly opening inlet in alignment with said net outlet opening for receiving basketballs from the net, said means to vary the velocity of the projected basketballs including a pair of undriven rollers rotatably supported vertically on said housing adjacent edge portions of said outlet, said rollers being spaced apart a distance less than the diameter of a basketball and an ejector pushing the basketball through the space between the rollers to eject the basketball from the projector, said vertical supported rollers including means supporting the rollers for lateral adjustment to vary the velocity of basketballs projected from the projecting device, said ejector including a movable plunger, a guide supporting said plunger, and means connected to said plunger to extend and retract the plunger.

15. The basketball return machine as defined in claim 14 wherein said means to extend and retract the plunger includes a ball shaft connected to said plunger, a non-rotative ball nut receiving said shaft, and a reversible motor drivingly connected to said shaft for reciprocating said plunger.

16. A basketball projecting device positioned to receive inflated spherical basketballs from a supply source of basketballs and singly projecting the basketballs toward at least one location on a basketball court to enable practice shots from such location, said basketball projecting device including means to preject basketballs, said means to project basketballs including a pair of freely rotating rollers supported on said projecting device, the distance between the facing surfaces of the peripheral walls of said rollers being spaced apart a distance less than the diameter of a basketball and mechanical means moving the basketballs through the space between the rollers to squeeze and resiliently deform opposite portions of the basketball inwardly until the center of the basketball passes a rotational center of the rollers thereby ejecting the basketball toward said location on the basketball court in response to the squeezed and resiliently deformed portions of the basketball exerting a reactive force against the rollers to thrust the basketball away from the rollers as the basketball returns to its original spherical configuration.

* * * * *